United States Patent [19]

White

[11] 4,218,886

[45] Aug. 26, 1980

[54] HYDRAULIC POWER PACKS

[75] Inventor: Gordon D. White, Tewkesbury, England

[73] Assignee: Bredon Hydraulics Limited, Tewkesbury, England

[21] Appl. No.: 963,788

[22] Filed: Nov. 27, 1978

[30] Foreign Application Priority Data

Nov. 30, 1977 [GB] United Kingdom ..... 49792/77

[51] Int. Cl.[2] ..... F15B 13/09

[52] U.S. Cl. ..... 60/486; 60/494; 60/DIG. 10

[58] Field of Search ..... 60/456, 484, 486, DIG. 10, 60/494, 477

[56] References Cited

U.S. PATENT DOCUMENTS

| | | | |
|---|---|---|---|
| 2,329,709 | 9/1943 | Fischer | 60/DIG. 10 |
| 2,643,516 | 6/1953 | Carlson | 60/486 X |
| 2,659,206 | 11/1953 | Carlson | 91/451 |
| 2,938,347 | 5/1960 | Sturgis | 60/456 |

*Primary Examiner*—Edgar W. Geoghegan
*Attorney, Agent, or Firm*—Frailey & Ratner

[57] ABSTRACT

A hydraulic power pack having a prime mover driving a plurality of hydraulic pumps, a hydraulic circuit including a reservoir connected to an inlet of said pumps, an outlet circuit from said pumps, one or more pressure relief valves in the outlet circuit and a plurality of external connectors on the outlet circuit. The connectors and the relief valves are arranged so that different hydraulic flow and pressure characteristics may be obtained from each connector. Each connector has a flow and a return line, the latter being connected to the reservoir. Valves provided in the hydraulic circuit are responsive to zero flow in the return line of each connector and are adapted to divert the hydraulic flow directly to the reservoir without restriction.

6 Claims, 18 Drawing Figures

HYDRAULIC POWER PACKS

This invention relates to hydraulic power packs, especially but not exclusively for use in the construction industry.

Hydraulic powerpacks are already available for providing power for operating hydraulic tools such as road breakers, rotary/percussive drills, cut-off wheels and water pumps. However, such known power packs suffer from a number of disadvantages. For example, known power packs generally have single output with fixed flow and pressure characteristics which may not suit the individual needs of a full range of tools. Alternatively, if adjustment is provided, it is accomplished by valves and gauges which are susceptible to misuse and damage. Furthermore, presently known power packs are bulky, inaccessible for maintenance, and cannot be left running when output to the tools is zero due to overheating.

An object of the present invention is to obviate or mitigate the aforementioned disadvantages.

According to the present invention there is provided a hydraulic power pack comprising a prime mover driving a hydraulic pump, a hydraulic circuit including a reservoir connected to the inlet of said pump, an outlet circuit from said pump, flow and return external connectors in said outlet circuit, a pressure relief valve for controlling the pressure of hydraulic fluid to said flow connector and a pilot operated main relief valve sensitive to flow conditions in said external connectors and adapted to divert the flow of said pump to said reservoir without restriction when no flow occurs through the external connectors.

Further, according to the present invention, there is provided a hydraulic power pack comprising a prime mover driving a plurality of hydraulic pumps, a hydraulic circuit including a reservoir connected to the inlet of said pumps, an outlet circuit from said pumps, one or more pressure relief valves in the outlet circuit and a plurality of external connectors on the outlet circuit, the connectors and said relief valves being arranged so that different hydraulic flow and pressure characteristics may be obtained from each connector.

Preferably, each connector includes a flow and a return line, the latter being connected to said reservoir and valve means provided in the circuit responsive to zero flow in the return line of each connector and adapted to divert the hydraulic flow directly to the reservoir, without restriction.

Preferably, the connectors providing different flow and pressure characteristics are of different sizes and are colour coded to avoid confusion.

Preferably also, an auxiliary connector is provided also having individual flow and pressure characteristics and being accessible only when a lever is operated to direct flow thereto.

Embodiments of the invention will now be described, by way of example, with reference to the accompanying drawings, in which.

Figure 16:
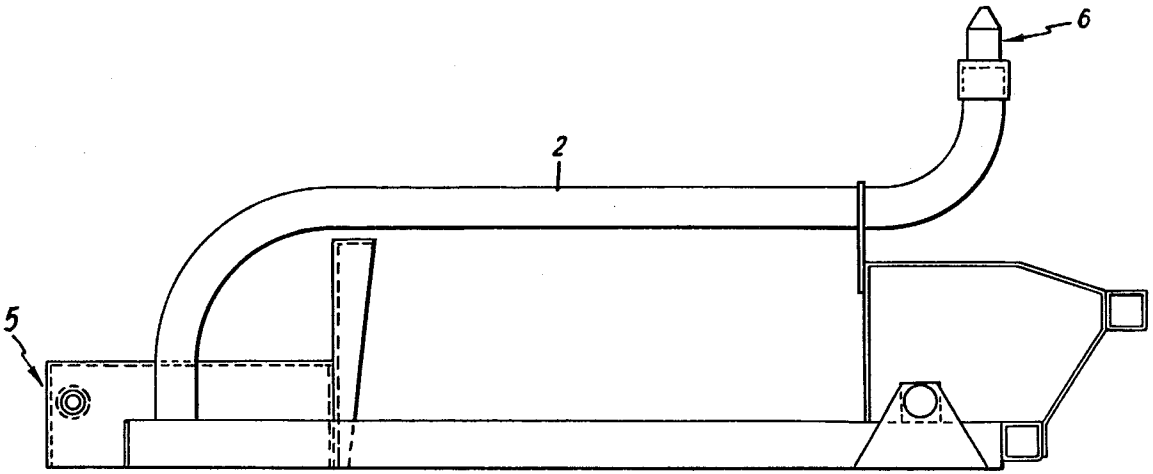
FIG. 16 is a side view of the bottom half of a chassis for a power pack according to the invention.
Figure 17:
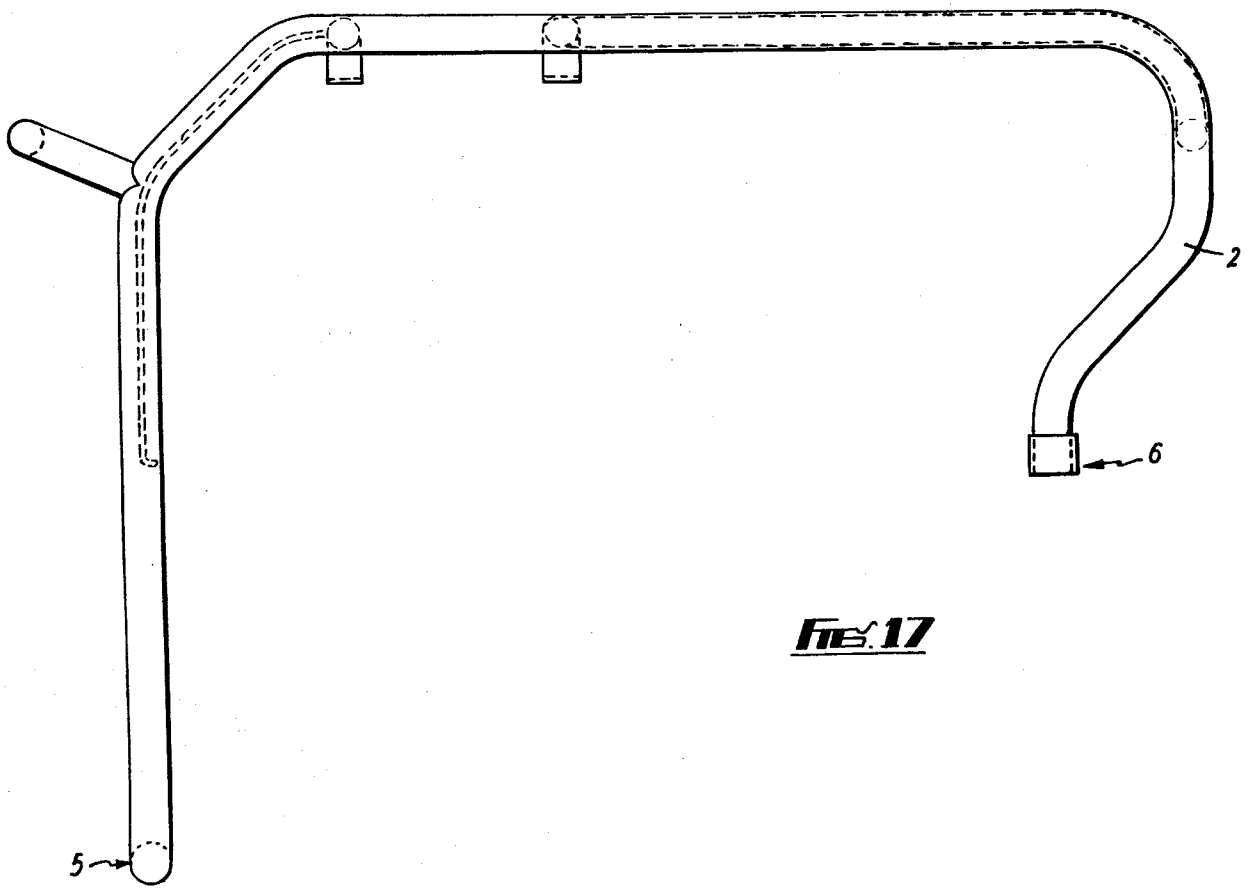
FIG. 17 is a side view of the top half of a chassis for a power pack according to the invention.

Referring now to the drawings, a portable power pack according to the invention is indicated generally at 1 and comprises a tubular metal frame 2 mounted on two rear wheels 3 and a single front jockey wheel 4. The frame 2 is shown in detail in FIGS. 16 and 17 and is hinged at 5 and is provided with an openable latch 6 to enable the frame to be opened like a book with some of the components of the power pack being mounted on the bottom half of the frame (FIG. 16) and the others on the top half of the frame (FIG. 17). With the frame in its open position most of the components of the power pack are easily accessible for maintenance. A prime mover in the form of a petrol-driven engine 7 is mounted on the frame and is adapted to drive a hydraulic gear pump 8 and a fan blower. A control panel 9 is provided on the front of the power pack and three hyraulic connectors 10, 11 and 12, respectively, are provided on the panel and to which hydraulic power tools may be connected by means of a flow line and a return line. The connectors 10, 11 and 12 are either of different sizes and/or are colour coded to ensure that the correct power tools are connected to their appropriate and compatible connector as the flow and pressure characteristics of the hydraulic output from each connector is different as will be explained in detail later. For convenience, pressure gauges 13 may be provided on the panel 9. Behind the panel 9 there is mounted a hyraulic oil reservoir 14 having a filler cap 15 and below which is mounted a pair of oil coolers 16, only one of which is shown.

Figure 1:
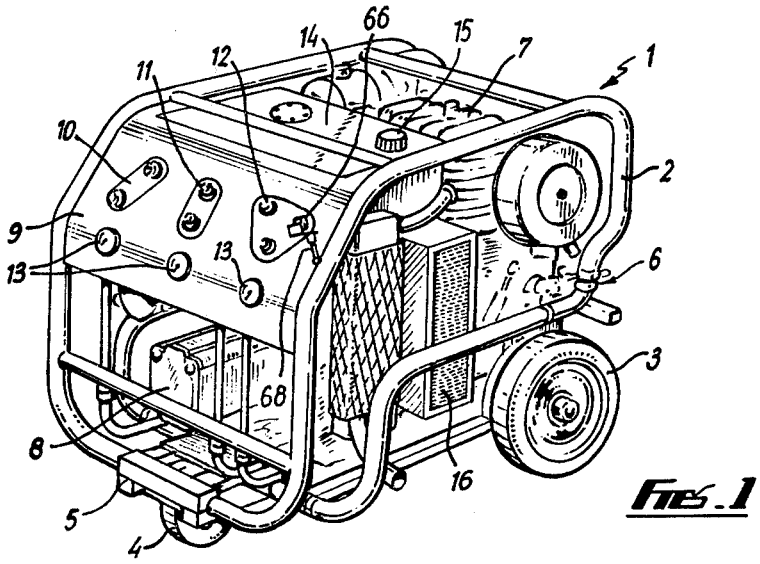
FIG. 1 is a perspective view of a power pack according to the invention.
Figure 2:
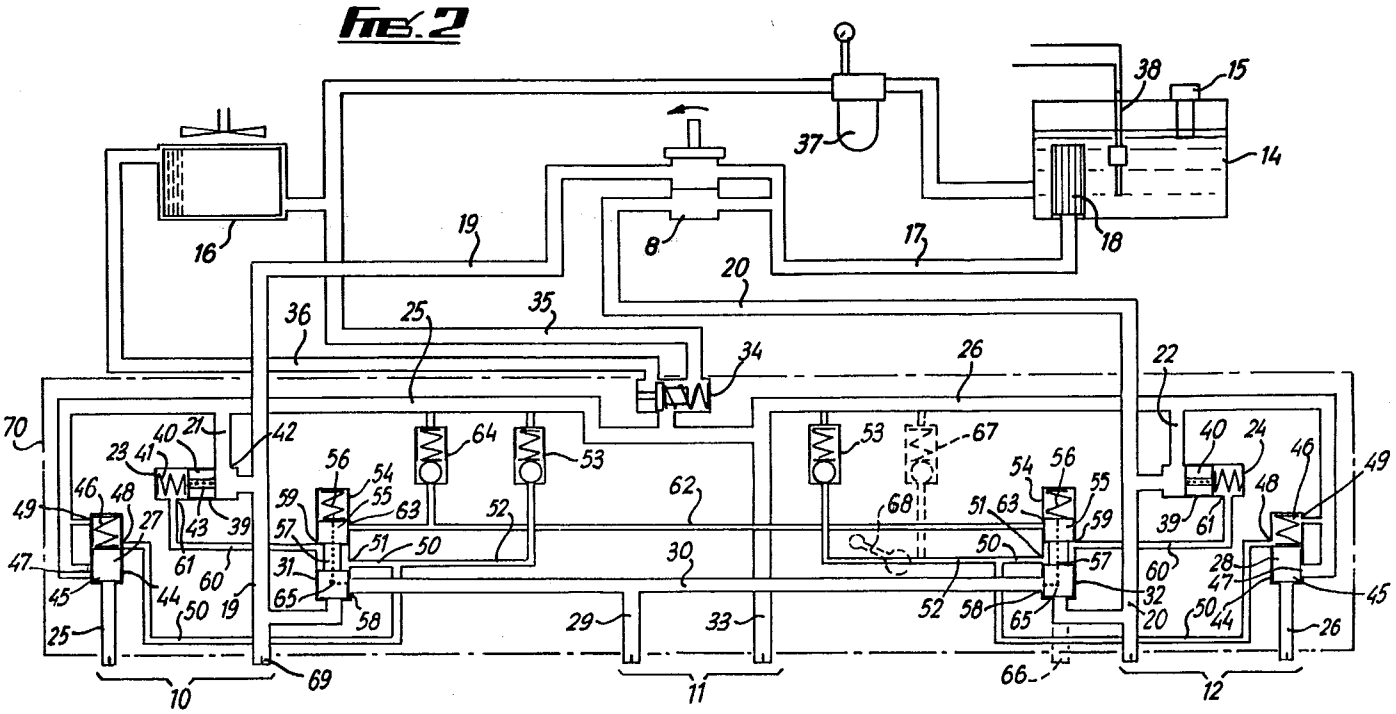
FIGS. 2 to 7 are hydraulic circuit diagrams of the power pack shown in FIG. 1.

Referring now to FIG. 2, the hydraulic circuit for the power pack shown in FIG. 1 comprises an outlet line 17 from the reservoir 14 having a strainer 18 at one end thereof and being branched at the other end to form the inlet to a twin gear pump 8 driven by the engine 7, the twin pump 8 has two outlet lines 19 and 20 connected respectively to the flow line of hydraulic connectors 10 and 12 and each having a branch line 21, 22 respectively, connecting it through a pilot-operated main relief valve 23, 24 to a return line 25, 26, the latter being connected through venting valves 27, 28 to the return line of the connectors 10 and 12. The flow line 29 of the connector 11 is connected through a common line 30 and through check and switching valves 31, 32 to the lines 19 and 20. The return line 33 of the connector 11 is connected directly to the return line 26. The return lines 25 and 26 are connected to the reservoir 14 through a thermostatic valve 34 which directs the flow to the reservoir either directly through the line 35 or along the line 36 to the oil cooler 16 and then through a filter 37 to the reservoir. The level of the reservoir is monitored by a float switch 38 which, if the level drops beyond a predetermined limit, will cut out the engine 7.

Figure 8:
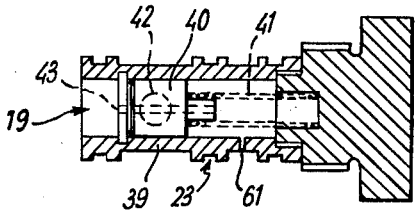
FIGS. 8 to 10 are sectional views of valves for the hydraulic circuits of FIGS. 2 to 7.
Figure 9:
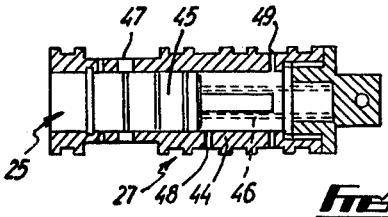

The main relief valves 23 and 24 are identical in construction and are shown in detail in FIG. 8 and comprise a casing 39 having a spool 40 reciprocable therein and biassed to one end thereof by a spring 41. The end to which the spool is biassed is connected directly to the line 19 (20) and the line 21 (22) is connected to a port 42 in the side of the casing 39 adapted to be opened or closed depending on the position of the spool 40. The latter has a hole 43 drilled through its centre to allow bleeding of hydraulic oil from one side of the spool to the other. The venting valves 27 and 28 are also identical in construction and are shown in detail in FIG. 9. Each valve comprises a casing 44 in which a spool 45 is reciprocable, the latter being biassed by a spring 46 to one end of the casing 44 to which the return line 25 (26) is directly connected from the connector 10 (12). A port 47 is provided in the side of the casing 44 which can be selectively covered or uncovered depending on the position of the spool 45. Additional smaller ports 48 and 49 are also provided in the casing 44 in positions so that the port 48 can be selectively open or closed depending on the position of the spool 45. The port 48 is connected through a line 50 to a port 51 of the check and switching valve 31 (32), the line 50 having a branch line 52 connected to a pressure relief valve 53, the outlet of which is connected to the return line 25 (26). The port 49 of the venting valve 27 (28) is connected to the return line 25 (26), as shown in FIGS. 2 to 7. The arrangement of the venting valve 28 and its connection with the check and switching valve 32 is identical to that described with reference to venting valve 27.

Figure 10:
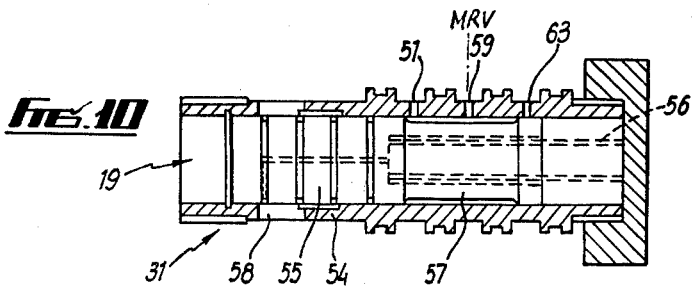

The combined check and switching valves 31 and 32 are again identical in construction and corresponding parts have been indicated by similar reference numerals in the drawings. Each valve comprises a casing 54 in which a shaped spool 55 is reciprocable, the latter being biassed towards one end of the casing by a spring 56. The spool 55 is a close fit in the casing 54 at both ends and has a portion of reduced diameter 57 in between. The check and switching valve is shown in detail in FIG. 10. The flow line 19 (20) of the connector 10 (12) is directly connected to one end of the valve 31 (32) and the common line 30 connects a port 58 on the valve 31 to the corresponding port 58 on the valve 32. As already described a port 51 is provided in the casing 54 and is connected to the line 50 and a further port 59 is provided in the casing to which is connected a line 60 passing to a port 61 in the casing 39 of the relief valves 23 and 24. A further common line 62 connects a port 63 provided in each of the valves 31 and 32 to a pilot relief valve 64. A bleed hole 65 is provided in the spool 55, as shown in FIG. 2.

An auxiliary flow line 66 is provided for the connector 12 and is connected directly to the check and switching valve 32, as shown in FIGS. 2 to 7. An associated auxiliary pilot relief valve 67 is also provided between the lines 52 and the return line 26 and a manually-operable shut-off valve is provided in the line 52 between the connection to the auxiliary pilot relief valve 67 and the pilot relief valve 53. The flow and return lines of each of the connectors 10, 11 and 12 are provided with a check valve 69 which opens only when a hydraulic hose is connected to that line. All of the valves and circuitry shown within the chain dotted line 70 in FIGS. 2 to 7 are contained within a manifold mounted underneath the control panel 9 on the power pack although in a modified form certain valves, such as the thermostatic valve 34, may be otherwise located in the power pack.

FIGS. 2 to 7 show the six operational conditions of the power pack, each operational condition providing a hydraulic output from the power pack having different flow and pressure characteristics. In the condition shown in FIG. 2 no output is being provided by any of the connectors 10, 11 or 12 as no hydraulic hoses have been connected to the flow or return lines. In this condition both venting valves 27 and 28 have their spools 45 in the position shown in FIG. 2 as no flow is being experienced in the return lines 25 and 26 to enable the spool to be biassed against the spring 46, thus leaving the ports 48 and 49 in communication across the casing 44. Furthermore, in this condition check and switching valves 31 and 32 are in the position shown in FIG. 2 thereby closing the ports 58 and allowing communication between the ports 51 and 59. The main relief valves 23 and 24 are also in the position shown in FIG. 2 due to the fact that the pressures from the pumps 8 are biassing the spool 40 against the spring 41 so as to open the ports 42, the spool 40 being allowed to move in that direction due to the fact that the opposite side of that spool is open to the return line 25 (26) via the line 60, ports 59 and 51, the line 50 and ports 48 and 49, thereby creating high pressure on the right-hand side of the spool 40, as viewed in FIG. 2 and low pressure on the left-hand side to enable the spool to move and open the port 42. Thus, the pumps are both pumping directly back to the reservoir 14 without the oil having passed through a pressure relief valve so that the return oil is virtually at atmospheric pressure in view of the fact that there is no hindrance to its flow apart from the light resistance due to the pressure of the springs 41 on the spools 40. In view of the fact that the spools 55 of the check and switching valves 31 and 32 both close the ports 58 no flow may pass to the flow line 29 of the connector 11.

Figure 3:
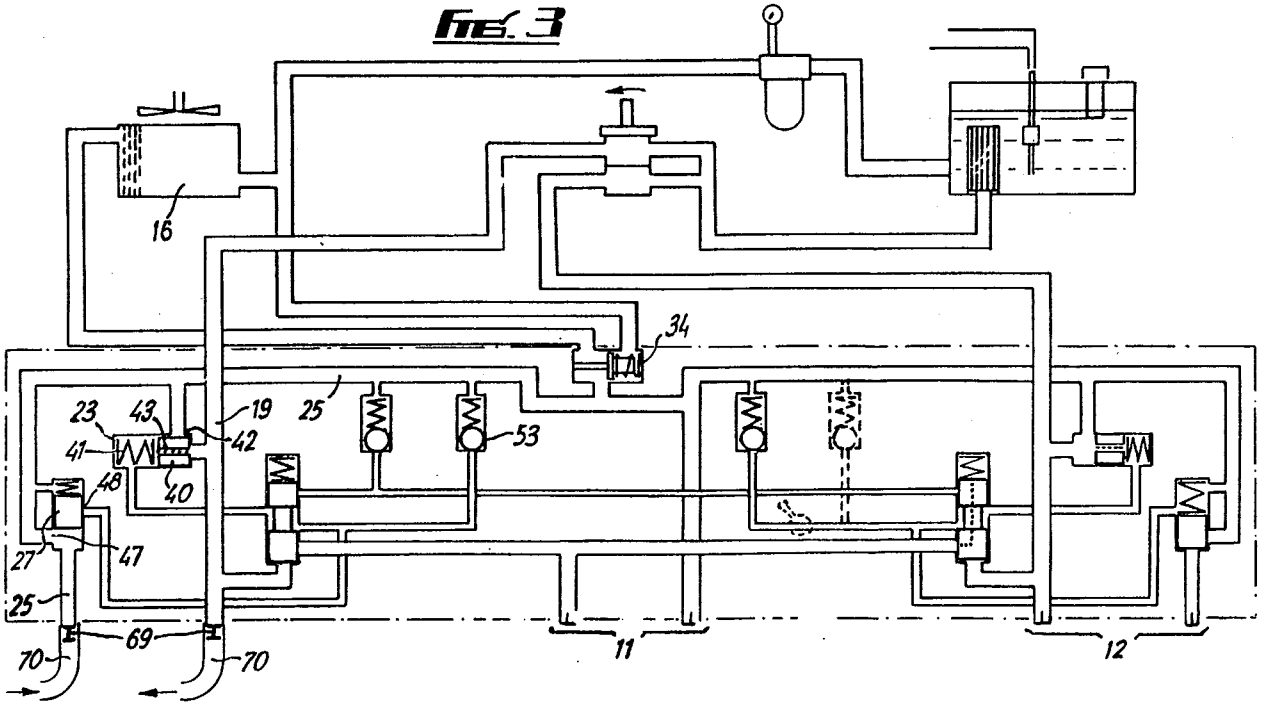

In the condition shown in FIG. 3 hydraulic hoses 70 have been connected to the flow and return lines of the connector 10, these hydraulic hoses 70 being in turn connected to a hydraulic power tool. In this case when both hoses have been properly fitted the check valves 69 open thereby allowing flow from one of the pumps 8 to pass along the line 19 through the tool and back to the venting valve 27 via the return line 25. Due to the slight differential in pressure caused by the spring 41 the venting valve spool will be moved upwardly to the position shown in FIG. 3 thereby opening the port 47 to allow the flow to continue to the reservoir 14 unhindered while simultaneously closing the port 48 thereby allowing pressure to equalise across the spool 40 of the main relief valve 23 by virtue of the central bleed hole 43 in the spool. As the pressure equalises the spring 41 biasses the spool 40 to the position shown in FIG. 3 thereby closing the port 42 to allow pressure to build in the line 19. When this pressure reaches the desired level suitable for the appropriate tool connected to the connector 10 the pressure relief valve 53 will lift thereby relieving the pressure on the left-hand side of the spool 40 which will enable the latter to move to the left in FIG. 3 so as to uncover the port 42 and will relieve the pressure in the line 19 to the return line 25. When the pressure is reduced to the correct level the pressure relief valve will reseat thereby causing the pressure to equalise across the spool 40 so that again it moves to the right in FIG. 3 to close the port 42. Thus, the pressure is automatically controlled between desired limits as set by the pressure relief valve 53 and the flow is that supplied by one of the pumps 8. In this condition the connectors 11 and 12 and the circuitry therefor are in the same condition as that described with reference to FIG. 2.

Figure 4:
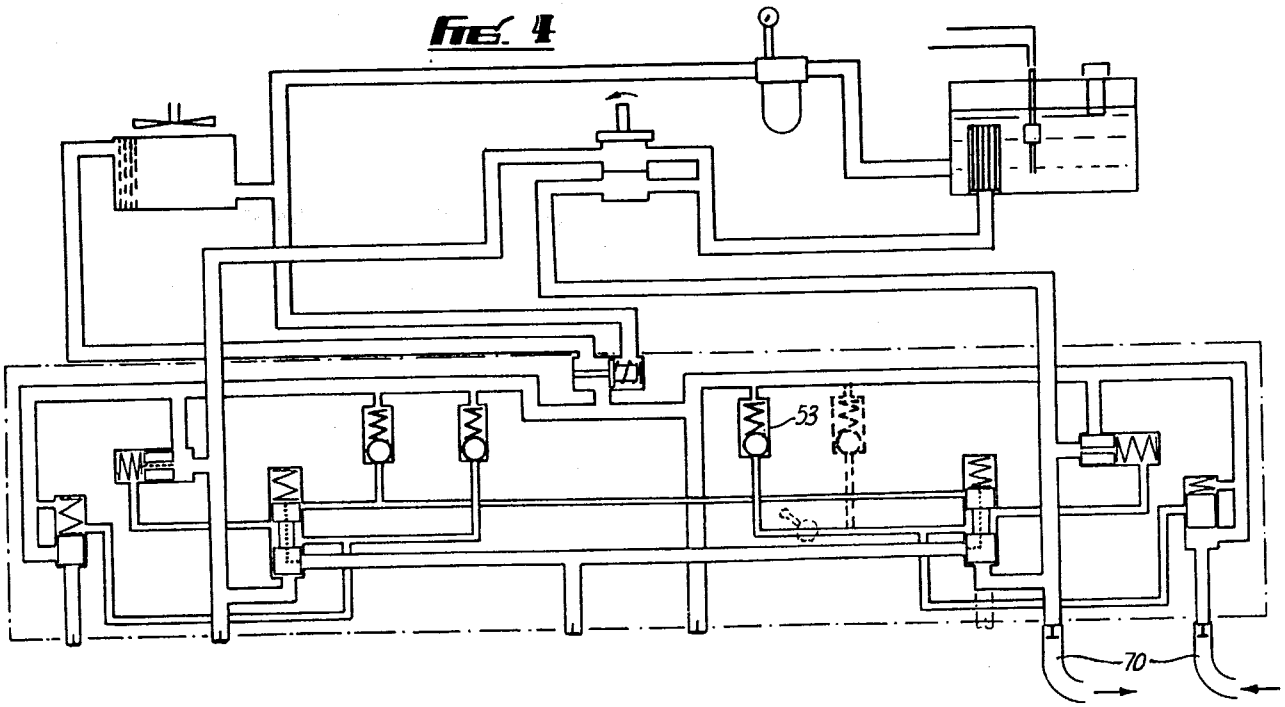
Figure 5:
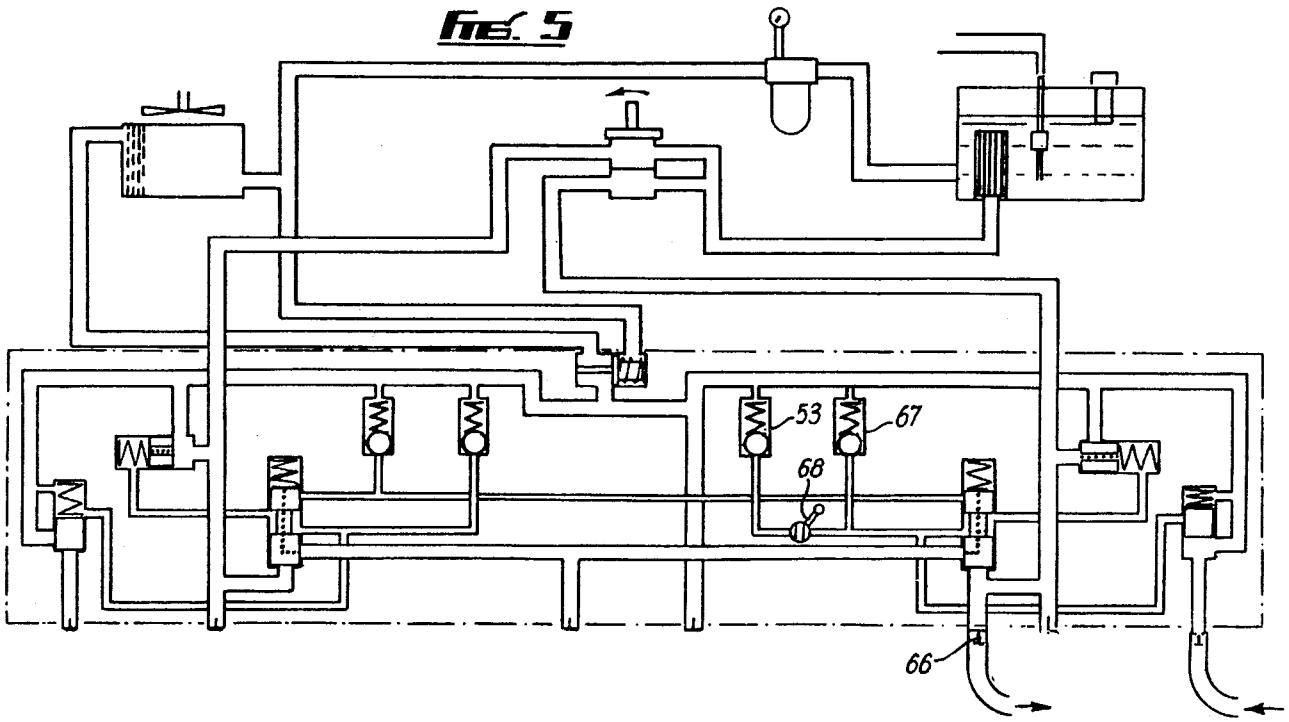

Referring now to FIG. 4, in this condition hydraulic hoses 70 have been connected to the connector 12. In this condition the operation of the various valves and the flows through the circuit are identical to that described in FIG. 3 except that the flow is that from the other pump 8 and the pressure supplied is controlled by a different pressure relief valve 53 so that different flow and pressure characteristics can be obtained from this connector to suit the appropriate power tool. If, however, the power tool being used requires the same flow characteristics of that condition shown in FIG. 4 with different pressure characteristics, the hose 70 connected to the flow line of the connector 12 can be alternatively connected to the auxiliary connector 66, as shown in FIG. 5. The construction of the control panel 9 of the power pack is arranged so that the auxiliary connector 66 is mechanically screened by the operating lever or an extension thereof of the switchover valve 68, as shown in FIG. 1. Thus, when the switchover valve is in the position shown in FIGS. 1, 2 and 3 it is physically impossible to connect a hose to the auxiliary connector 66. To enable connection the switchover valve 68 must be moved to the position shown in FIG. 5. In this position the switchover valve prevents flow to the pressure relief valve 53 which controls the pressure in the condition described in FIG. 4 and instead allows the pressure supplied through the auxiliary connector to be controlled by the auxiliary pressure relief valve 67, which pressure would be higher than that dictated by the pressure relief valve 53, otherwise the operation of the system is identical to that described with reference to FIG. 4.

Figure 6:
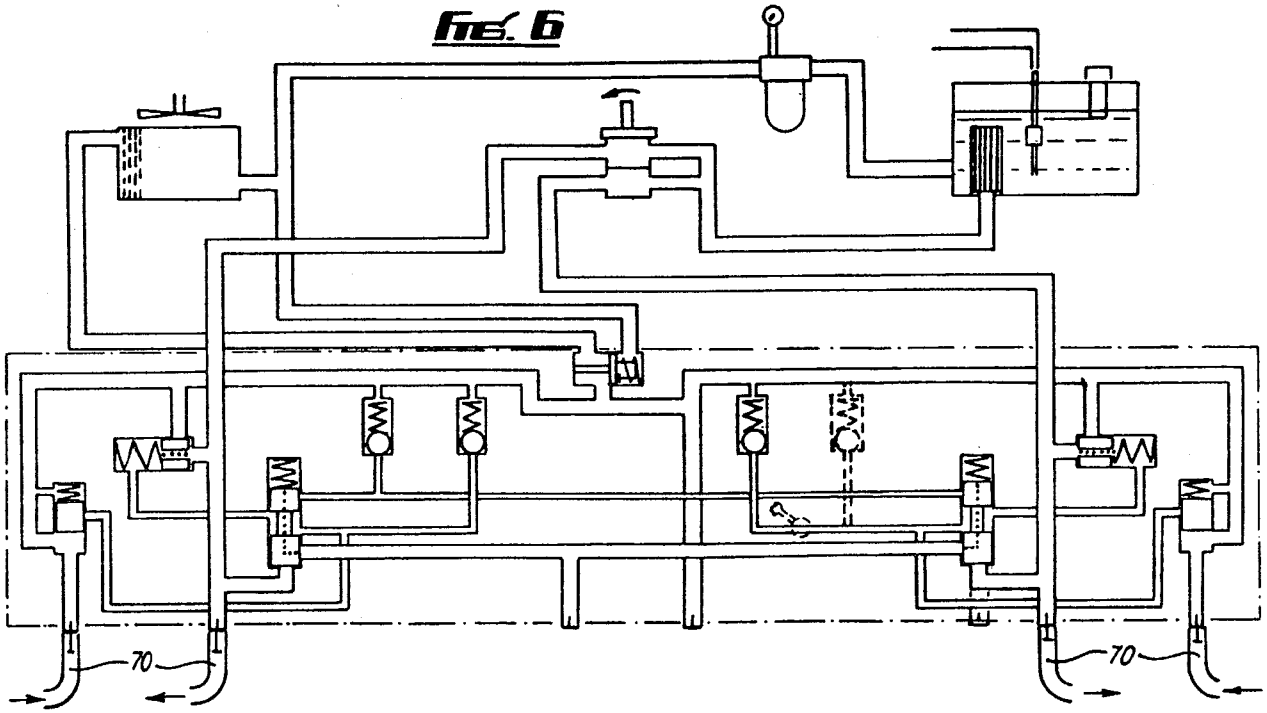

As can be seen from the condition shown in FIG. 6 hydraulic hoses 70 can be connected to connectors 10 and 12 simultaneously thereby operating two power tools at the same time. In this condition operation of the various valves and flow through the circuitry is identical to that described with reference to FIGS. 3 and 4.

Figure 7:
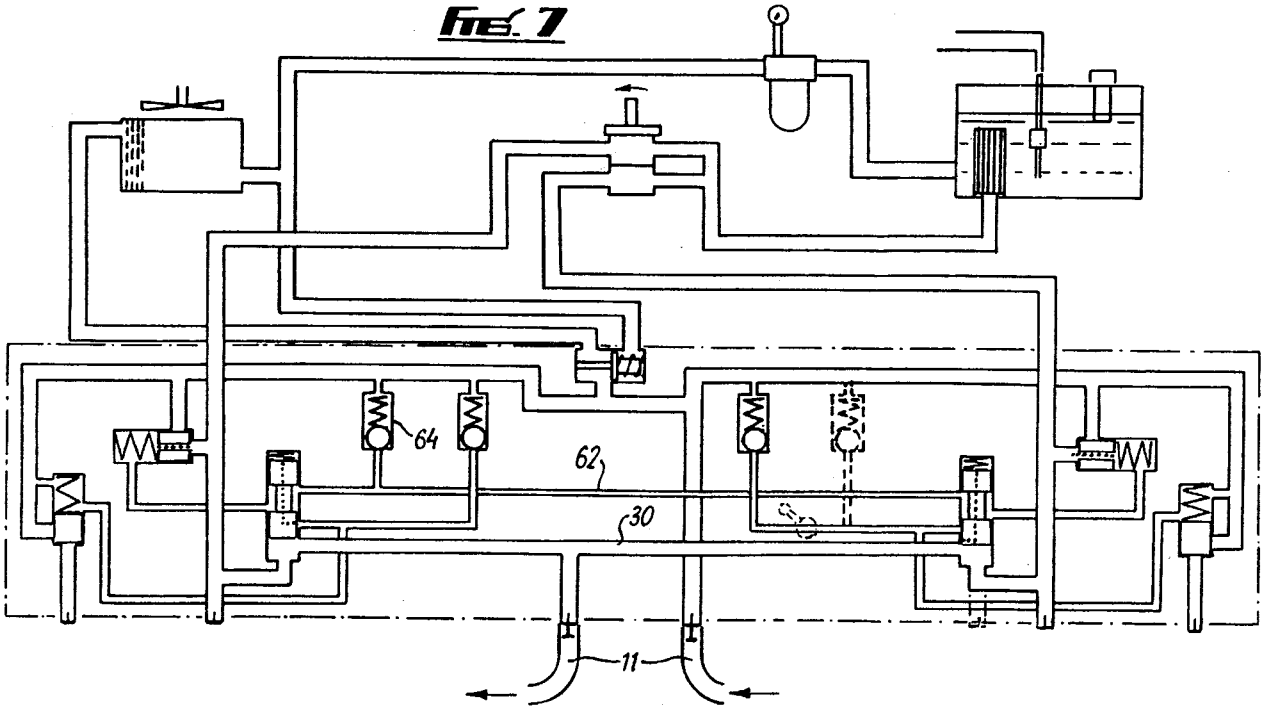

In the condition shown in FIG. 7 hydraulic hoses 70 are connected to connector 11 and the connectors 10 and 12 are dormant. In this condition the ability of hydraulic oil to flow along the common line 30 to the flow line 29 of the connector 11 causes both spools 55 of the check and switching valves 31 and 32 to lift to the position shown in FIG. 7, thereby opening the ports 58 and 63 and closing the ports 51, thus communicating the spring side of the spools 40 of the main relief valves 23 and 24 to the line 62 and to the pressure relief valve 64. Operation of the valving and circuitry is similar to that described previously except that the flow from the connector 11 is the combined flow from the pumps 8 being delivered at a pressure determined by the pressure relief valve 64.

The temperature of the hydraulic oil is preferably controlled to a maximum of 42° C. by means of the thermostatic valve 34 which, when the temperature of the oil is below 42° C., is in the position shown in FIG. 2 thereby allowing the return flow of oil to pass directly to the reservoir. When the temperature of the oil exceeds 42° C. the valve 34 moves to the position shown in FIG. 3 thereby diverting the return flow of oil through the oil coolers 16 before passing to the reservoir 14. The thermostatic valve is of the type which has a high range between its fully opened and fully closed positions so that when the temperature of the oil is within that range the valve will operate part open and the flow will be split between the oil cooler circuit and the circuit direct to the reservoir.

Figure 18:
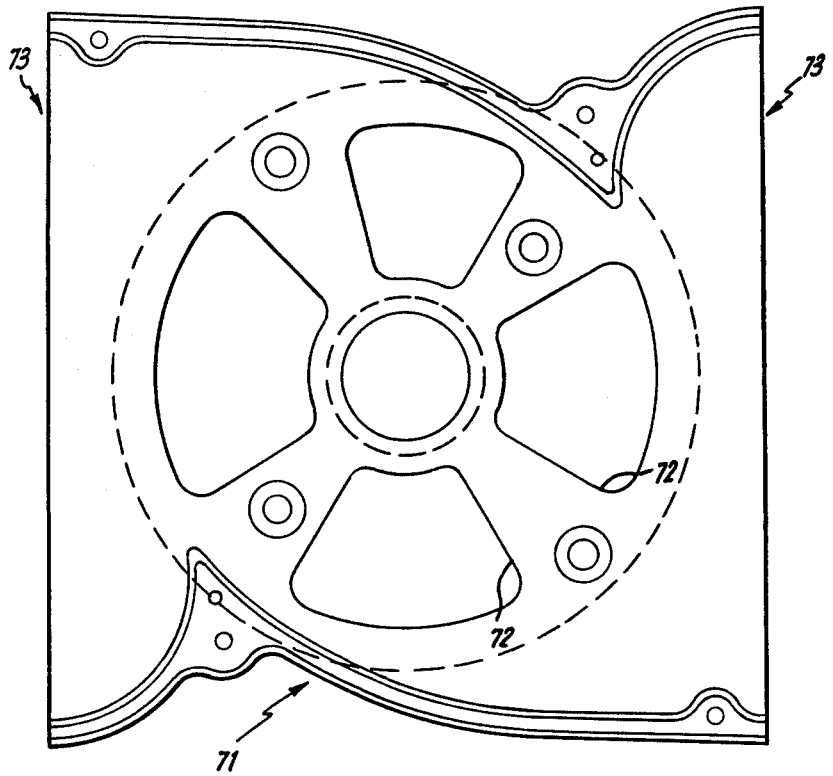
FIG. 18 is a sectional view through a fan casing.

The oil cooler 16 comprises two heat exchangers arranged on opposite sides of a single casing 71 as shown in FIG. 18, the latter containing a centrifugal fan (not shown) which draws in cool air through central ducts 72 and propels the air through outlet ducts 73 into the heat exchangers 16.

The fan is mounted directly on to an extension of the crankshaft of the engine as are the pumps 8.

Figure 11:
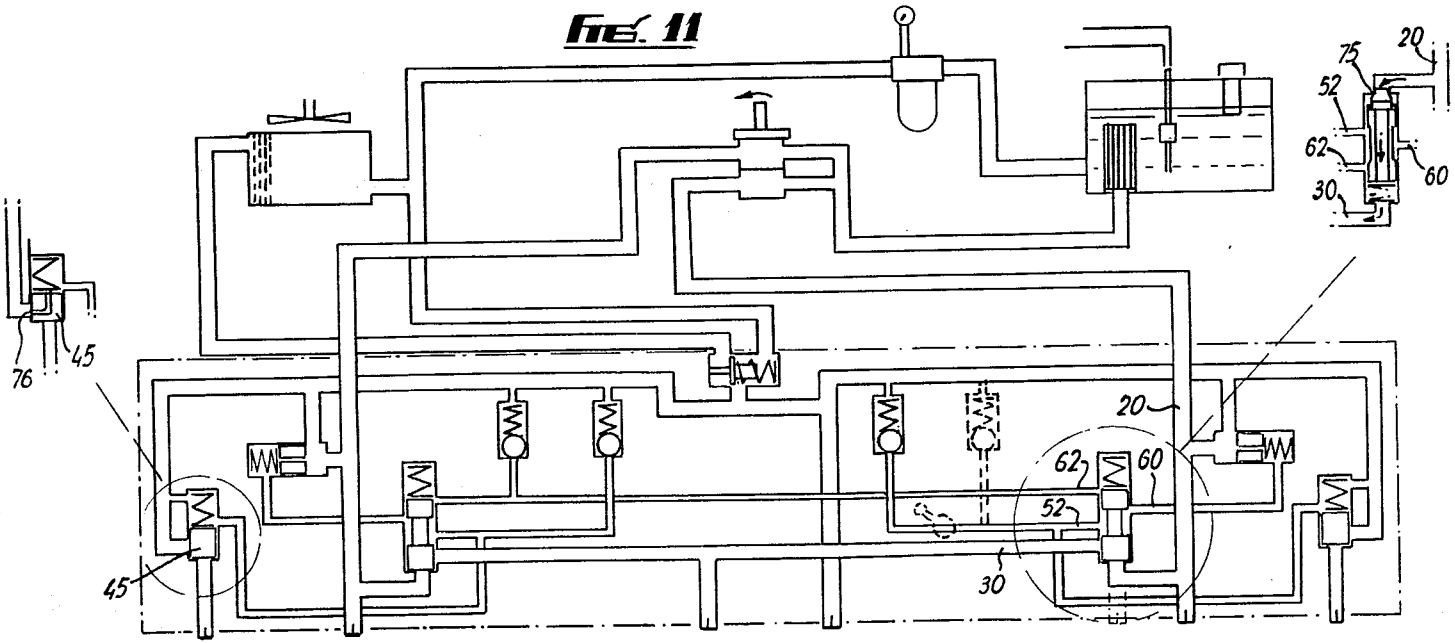
FIG. 11 is a view corresponding to FIG. 2 and showing as inserts modified valve arrangements.
Figure 12:
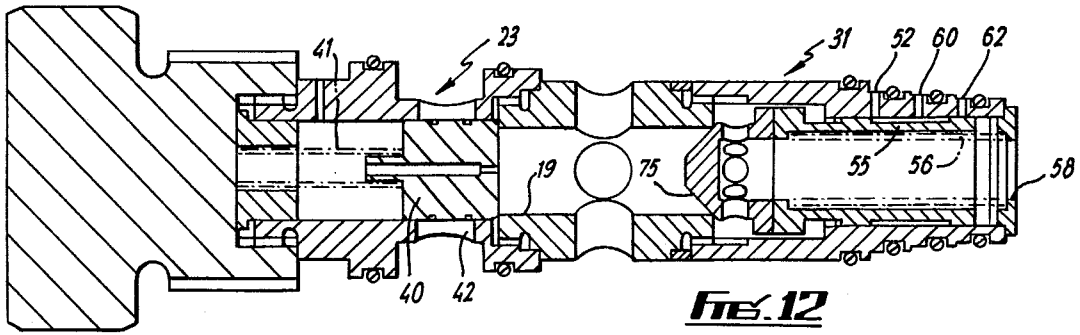
FIG. 12 is a sectional view of a modified combined main relief, check and switching valve.

In a modified embodiment the check and switching valves 31, 32 are combined with their associated main relief valves 23, 24 into a single valve as shown in FIG. 12 and in this embodiment the check and switching valves 31, 32 are reversed and a conical seat 75 is provided on the end of the spool 55 so that more positive checking of flow is achieved between the lines 19 (20) and 30. The alternative circuit for this arrangement is shown as an insert on FIG. 11. Moreover, in an alternative embodiment of the venting valves 27, 28 as shown in an additional insert on FIG. 11 the spool 45 is provided with a bleed hole 76 as shown.

Figure 15:
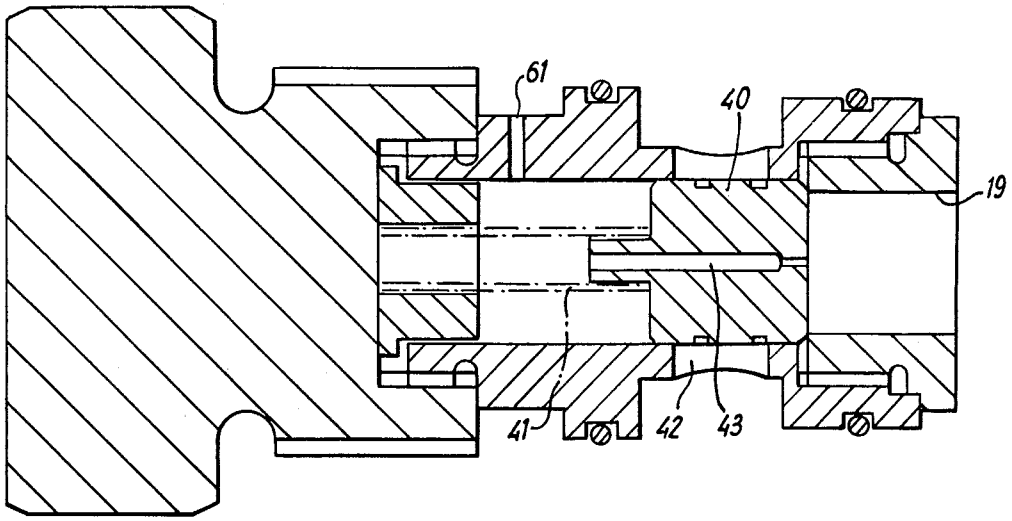
FIG. 15 is a sectional view of a main relief valve for the circuit shown in FIGS. 13 and 14.
Figure 13:
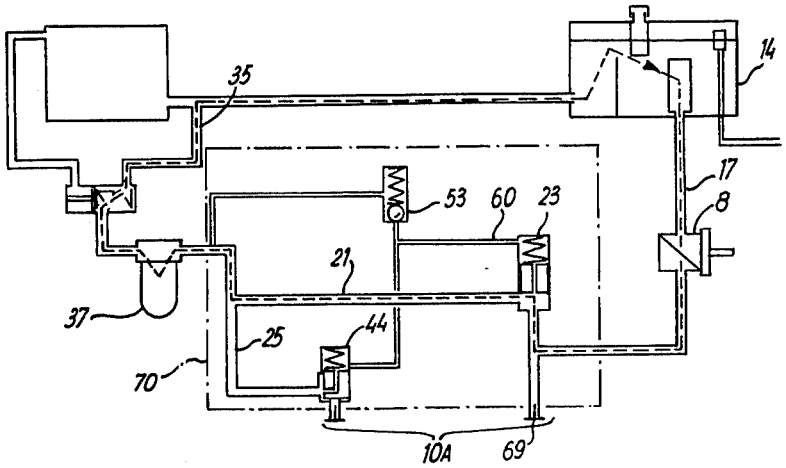
FIGS. 13 and 14 are circuit diagrams of a single circuit power pack.
Figure 14:
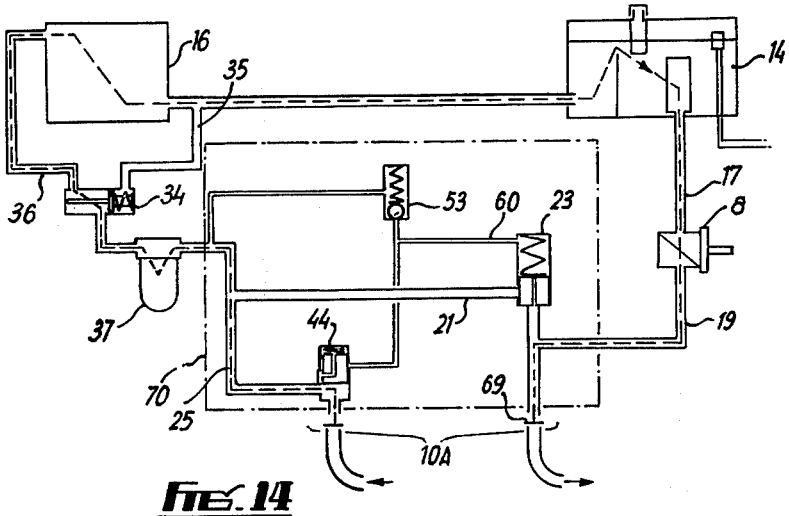

FIGS. 13, 14 and 15 show circuit diagrams and a main relief valve for a power pack according to the invention which has a single outlet and return 10A, FIG. 13 showing the circuit with no flow through the outlet and FIG. 14 showing the circuit with a tool connected and operating. Corresponding parts with those of the multiple option circuit previously described have been indicated by similar reference numerals, the main differences with the circuit already described being that no check and switching valve is required and a single pump 8 is used. Otherwise operation of the circuit is similar to that previously described with flow being returned to the reservoir without obstruction when no flow is taking place to a tool connected to the outlet thereby increasing the efficiency of operation.

In a still further embodiment a direct mechanical connection may be provided between one of the check valves 69 and the venting valve so that positive operation of the latter occurs when an outlet connection is coupled and uncoupled.

While the above power pack has been described with reference to a petrol-driven engine clearly a diesel engine or electrical motor could be used.

From the above description it will be clear that the power pack is capable of providing a number of different hydraulic outputs, each having different pressure and flow characteristics to suit the individual needs of power tools. Moreover, by use of colour coding and different size connectors the possibility of operator error is diminished.

Improvements or modifications may be made without departing from the scope of the invention.

What I claim is:

1. A hydraulic power pack comprising a prime mover driving a hydraulic pump, a hydraulic circuit including a reservoir connected to an inlet of said pump, an outlet circuit from said pump, flow and return external connectors in said outlet circuit, a pressure relief valve for controlling the pressure of hydraulic fluid to said flow connector and a pilot operated main relief valve sensitive to flow conditions in said external connectors and adapted to divert the flow of said pump to said reservoir without restriction when no flow occurs through the external connectors.

2. A hydraulic power pack comprising a prime mover driving a plurality of hydraulic pumps, a hydraulic circuit including a reservoir connected to an inlet of said pumps, an outlet circuit from said pumps, one or more pressure relief valves in the outlet circuit and a plurality of external connectors on the outlet circuit, the connectors and said relief valves being arranged so that different hydraulic flow and pressure characteristics may be obtained from each connector, each connector having a flow and a return line, the latter being connected to said reservoir, and valve means provided in the circuit responsive to zero flow in the return line of each connector and adapted to divert the hydraulic flow directly to the reservoir, without restriction.

3. A hydraulic power pack as claimed in claim 2, in which the connectors providing different flow and pressure characteristics are of different sizes and are colour coded to avoid confusion.

4. A hydraulic power pack as claimed in claim 3, in which an auxiliary connector is provided also having individual flow and pressure characteristics and being accessible only when a lever is operated to direct flow thereto.

5. A hydraulic power pack as claimed in claim 1 in which operation of said pilot operated main relief valve is controlled by a venting valve which is sensitive to flow conditions at the return flow connector.

6. A hydraulic power pack as claimed in claim 2, in which a plurality of combined check and switching valves are provided, operation of which is sensitive to flow through the external connectors and which are adapted to selectively divert the flow of said pumps either to different connectors or to a single connector.

* * * * *